United States Patent [19]

Volgel et al.

[11] 4,076,174

[45] Feb. 28, 1978

[54] SPRAY NOZZLE FOR DISPENSING CONTAINERS

[75] Inventors: Günter Melchior Volgel; Wendelin Velten, both of Nurnberg, Germany

[73] Assignee: Aerosol Inventions & Developments S.A. Aid SA, Switzerland

[21] Appl. No.: 670,860

[22] Filed: Mar. 26, 1976

[51] Int. Cl.[2] ..... B05B 1/34

[52] U.S. Cl. ..... 239/492; 239/590.5; 239/600

[58] Field of Search ..... 239/490–493, 239/590.3, 590.5, 600; 222/520, 540, 544, 545, 547, 563

[56] References Cited

U.S. PATENT DOCUMENTS

| | | | |
|---|---|---|---|
| 1,431,526 | 10/1922 | Jacobsen | 239/490 |
| 2,921,741 | 1/1960 | Burman | 239/492 X |
| 3,129,893 | 4/1964 | Green | 239/490 |

FOREIGN PATENT DOCUMENTS

| | | | |
|---|---|---|---|
| 13,221 of | 1915 | United Kingdom | 239/493 |

*Primary Examiner*—Evon C. Blunk
*Assistant Examiner*—Andres Kashnikow
*Attorney, Agent, or Firm*—Holman & Stern

[57] ABSTRACT

A spray tip or button comprising a tip body, a break-up insert mounted in a recess provided in said body and communicating with a passage for admission of a fluid, and at least one intermediate member interposed in the recess between the passage and the insert, the intermediate member defining at least one metering orifice for the passage of the fluid into an expansion chamber between that chamber and at least one channel opening in a fluid collecting chamber of the insert.

10 Claims, 3 Drawing Figures

SPRAY NOZZLE FOR DISPENSING CONTAINERS

FIELD OF THE INVENTION

The invention relates to spray tips or buttons. Primarily it is of interest in the construction of a spray tip or button for pressurised dispensing containers, such as those commonly known as aerosol containers.

BACKGROUND OF THE INVENTION

Spray tips or buttons such as those currently used on hand-held pressurized dispensers for various liquids under pressure in the field of household products or cosmetic products, for example, generally have a break-up insert at the outlet of a recess provided in the body of the spray tip or button, into which recess there opens a passage for fluid from the interior of the container. This passage may itself communicate with the interior of the container through a valve, which generally has a hollow rigid stem which at the same time forms a member providing manual control of the valve.

It is known that the penetration, spread, homogeneity and fineness of the resulting spray pattern are closely linked to the design of the insert in conjunction with the pressure at which the fluid reaches it. In one known design, which is particularly conducive to good results the insert, of the so called "swirl" type, has tangential channels leading to an orifice through which the liquid under pressure is expelled to atmosphere, broken up into fine droplets to form a divergent spray pattern.

The introduction of high pressure dispensers leads to the need for a modification of the above-mentioned spray tips, designed for lower pressures, and this applies especially in the case of designs with swirl-type inserts, for the functioning of these inserts is markedly changed under high pressure. In the known constructions, the modification consists of interposing in the path of the fluid, inside the control stem of the valve, restricting or metering members of a cross-section which lead to a marked pressure drop in the fluid emerging from the container. This design has the drawback of complicating the manufacture of the article and making it difficult to fill the container through the valve.

SUMMARY AND PURPOSE OF THE INVENTION

The aim of the present invention is to provide a spray tip or button that allows the drawbacks of the known tips to be reduced, in particular to achieve a good spray pattern with liquids contained at a high pressure and that is well suited to simple manufacture by moulding of the elements which go to make it up and by automatic assembly of these elements without significant modification to existing installations.

According to the invention, a spray tip or button especially for pressurised dispensing containers, has a break-up insert, mounted in a recess provided in the body of the tip or button and communicating with a passage for admission of the fluid and at least one intermediate member interposed in the recess between the passage and the insert, the intermediate member having at least one metering orifice for the passage of the fluid and defining an expansion chamber between that member and the insert.

The insert and the intermediate member are preferably mounted in the recess by axial insertion and have abutment surfaces for engaging against one another and against the body.

The break-up insert may be made in any of the known ways, however, the insert is preferably of the swirl type. Moreover, it is advantageous to provide on the intermediate member an axially extending nose coming into contact with the internal rear face of the insert and defining, together with it, tangential channels leading to an orifice which is open to atmosphere.

Other features of the invention concern the particular shape of the break-up insert, of the intermediate member and of the recess that receives them, which cooperate to facilitate automatic assembly by axial insertion of the intermediate member and the insert, either simultaneously or preferably in succession. In particular the insert and the intermediate member may have annular skirts designed to be guided in axial sliding engagement in respective different parts of the recess, preferably of different diameters. As an alternative or in addition to this, the skirt on the intermediate member may be guided in sliding axial engagement inside the skirt of the insert.

DESCRIPTION OF THE FIGURES OF THE DRAWING

Further features of the invention will become clear from study of the following description of some preferred embodiments by way of example. In the accompanying drawings to which the description refers, each of FIGS. 1, 2 and 3 represent diagrammatically a longitudinal section through a respective one of three variants of a spray tip with a swirl-type insert.

DESCRIPTION OF PREFERRED EMBODIMENTS

Figure 1:
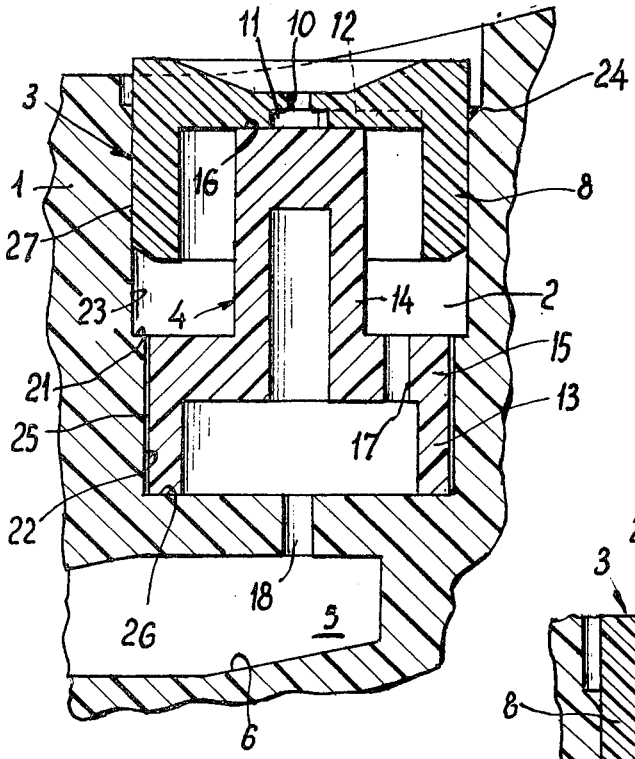

The spray tip which is illustrated is designed to fit a hand-held pressurised dispensing container of a design known in itself, closed by a valve of which control is achieved by a hollow actuating stem which at the same time forms a path for the passage of the liquid from within the container to the spray tip or button.

In the body 1 of this spray tip or button there is a stepped cylindrical recess 2 which receives a break-up insert 3, an intermediate member 4, and a passage 5 leads from a valve stem (not shown) into the recess 2 and forms the path for liquid from within a container on which the valve stem and spray tip are mounted. The recess 2 and the passage 5 open to the outside of the body 1 of the spray tip on two respective mutually perpendicular faces. When the spray tip is in place on a container, the axis of the recess 2 is horizontal and the passage 5 is vertical and fits over the end of the hollow actuating stem on the valve which comes to butt against the inclined wall 6 in FIG. 1 or against the shoulder 7 in FIGS. 2 and 3. However, in these Figures, the spray tip has been shown in the position used for its manufacture in automatic installations, the recess 2 being at this stage facing upwards.

The insert 3 and the intermediate member 4 are mounted one upon the other in the recess 2 in a manner such as to define together and possibly with the walls of the recess an expansion chamber in which the pressure of the liquid present, which has reached there through a metering orifice, is reduced to a value compatible with optimum operation of the insert, and more particularly the insert of the swirl type used here.

The insert 3 is a standard insert already used in known spray tips. It is constituted by a single cup-shaped member in the form of a circular disc with a cylindrical skirt 8 which extends towards the interior of the recess 2. The surface of the outer face of the insert diverges conically, starting from a central orifice 10. The latter communicates with a swirl chamber 11 into which there open tangentially four channels 12, which intersect one another at 90°, these channels being formed in the rear internal face of the insert and defined by the nose of the intermediate member 4 which comes into direct contact with the rear internal face of the insert on the axis of the recess.

The intermediate member 4 is formed by a single component having a cylindrical skirt 13 and a cylindrical co-axial nose 14 both extending axially away from an annular portion 15 which joins them. The nose 14 has an external diameter which is less than that of the skirt 13 and is also less than the internal diameter of the skirt 8 of the insert. It is hollow but is closed at its flat upper end 16 which comes into contact with the internal face of the insert 3 and of which the diameter is such that it helps to define the swirl chamber 11 and also defines the channels 12 over only a part of their length. The annular portion 15 is pierced by a calibrated metering orifice 17 or a number of similar orifices, which provide a communication between the region inside the skirt 13 and that outside the nose 14. The shape and dimensions of the recess 2 in the body 1 are determined by those of the insert 3 and the intermediate member 4 such as to allow assembly by axial insertion, first of the intermediate member 4, then of the insert 3, or of both of them simultaneously, and to ensure that when the insert is in abutting engagement with the upper end 16 of the intermediate member the skirt 13 on the latter is itself in engagement with the flat base of the recess 2, around a metering orifice 18 (FIG. 1) or a larger passage 19 (FIGS. 2 and 3) which opens axially into the recess 2 and into the side of the passage 5.

In the embodiment shown in FIG. 1, the recess 2 is again divided by an internal shoulder 21 into two parts of different diameters. The inner part 22 of the recess has a diameter smaller than that of the outer part 23. The intermediate member 4 has the skirt 13 of which the outside diameter is substantially equal to the diameter of the inner part 22 of the recess; its axial extent is greater than (or at least equal to) that of the skirt 8 on the insert. The outside diameter of this skirt 8 corresponds to the diameter of the outer part 23 of the recess such as to make it a force fit. Its introduction into the recess is facilitated by a chamfer 24.

It will be understood that in the embodiment shown in FIG. 1 the insert 3 and the intermediate member 4 are thus quided individually in axial sliding engagement, each directly in contact with the walls of the recess 2. Assembly of these two elements is easy to achieve automatically, by introducing first the intermediate member 4 until it engages the bottom end of the recess, then the insert 3, which is forced in until it engages the member 4. This only involves a minor modification of existing automatic assembly installations, by the addition of a station at which the member 4 is inserted.

Once assembly is complete, an expansion chamber preceding the insert is defined at the exit of the metering orifice 17 by the intermediate member 4, the insert 3 and the walls of the outer part 23 of the recess 2. A pre-expansion chamber is defined by the base of the recess and the member 4 at the exit to the metering orifice 18.

As shown in FIG. 1, the skirt 13 of the intermediate member does in fact have a slight play or clearance 25 in the body 1. This clearance not only facilitates assembly of the member but furthermore it ensures firm engagement of the upper end 16 against the internal face of the insert and consequently the sealing of the expansion chamber at this point. Sealing is obtained moreover at the contact of the end of the skirt 13 with the base of the recess (at 26) and at the engagement between the skirt 8 of the insert and the body 1 (at 27).

Figure 2:
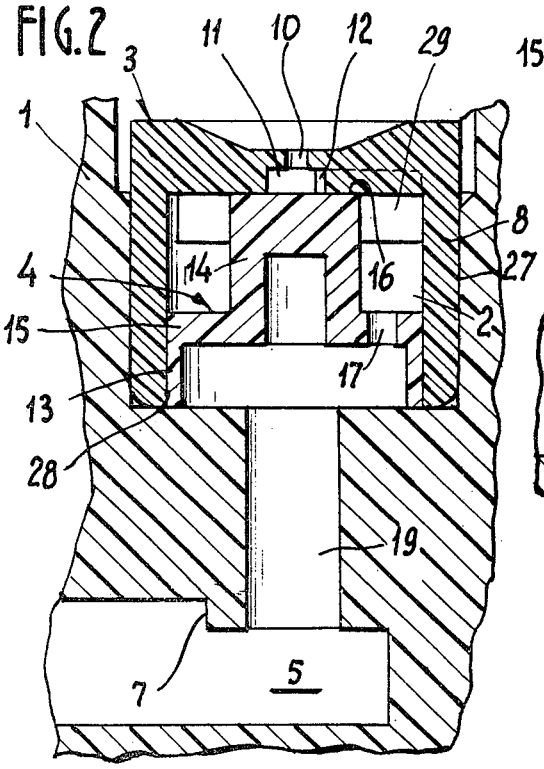

In the version shown in FIG. 2, the manner of assembly differs from that described above in that the intermediate member 4 is placed inside the insert 3 until the end 16 engages the rear internal face of the insert, before this assembly is introduced into the recess 2. The member 4 has, at the level of its skirt 13, an outside diameter which is substantially equal to the inside diameter of the skirt 8 of the insert (but designed to allow forcible engagement) and its overall length is equal to that of the skirt 8 of the insert. The skirts of both the insert 3 and the member 4 thus come into engagement with the base of the recess 2. The expansion chamber at the exit to the orifice 17 is defined entirely by the insert and the member 4. Sealing takes place at the end 16, between the body 1 and the skirt 8 of the insert (at 27) and between the two skirts 8 and 13 (at 28).

Figure 3:
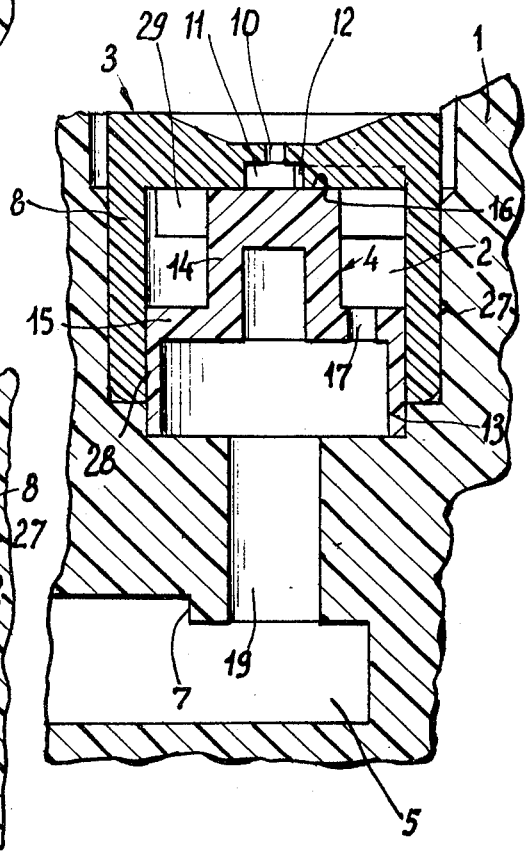

The embodiment shown in FIG. 3 is a sort of combination of the two earlier embodiments. Like that of FIG. 2, it facilitates assembly by successive introduction of the intermediate member 4 and the insert 3. With this in mind, the skirt 13 on the member 4 projects from the insert and to receive it the base of the recess 2 is recessed further in relation to the shoulder that receives the skirt 8 of the insert. In this case the sealing between the passage that admits the fluid and the expansion chamber may be between the two skirts as in the embodiment shown in FIG. 2 or at the region of contact of the skirt 13 of the intermediate member with the base of the recess 2.

Moreover in the embodiments shown in FIGS. 2 and 3 the intermediate member 4 carries around the nose 14 fins or webs 29 at 120° to each other, ensuring that the insert 3 is centralised and square to the axis of the recess.

What we claim is:

1. A spray-tip assembly comprising a tip body, said body including a recess communicating with a passage for receiving presurized fluid;

a swirl break-up insert mounted axially within said recess; and an intermediate member mounted axially within said recess between said passage and said swirl break-up insert.

said intermediate member comprising a cylindrical skirt abutting against a base portion of said recess and extending around the passage for receiving the pressurized fluid, said intermediate member including an axially-extending nose defining thereabout and with said recess an annular expansion chamber, said swirl break-up insert including a depending skirt at least partially limiting said expansion chamber, said nose having an upper end surface abuttingly-engaging an inner confronting surface of said swirl break-up insert and including portions cooperating therewith and defining a collecting-chamber communicating with channels tangential with respect to an outlet orifice in said swival break-up insert, said intermediate member including an intermediate shoulder between said cylindrical skirt and said nose, and at least one metering-orifice in said shoulder communicating with said expansion chamber.

2. A spray assembly according to claim 1 in which the cylindrical skirt of the intermediate member includes at least a portion guided in sliding axial engagement directly in walls of the recess.

3. A spray tip assembly according to claim 2 in which the at least a portion of the cylindrical skirt of the intermediate member is also guided in sliding axial engagement with the depending skirt of the swival break-up insert.

4. A spray tip assembly according to claim 1 in which the depending skirt of the swivel break-up insert is in sliding axial engagement with the walls of said recess.

5. A spray tip assembly according to claim 4 in which the recess has an internal shoulder between an inner part of smaller diameter for guiding the intermediate member and an outer part of larger diameter for guiding the swivel break-up insert.

6. A spray tip assembly according to claim 1 in which the said passage for receiving pressurized fluid opens through a metering orifice into a pre-expansion chamber defined between the intermediate member and the base of the recess.

7. A spray tip assembly according to claim 1 in which the skirt of the intermediate member has a clearance in the surface in which it is received and the swival break-up insert is force-fitted in the recess.

8. A spray tip assembly according to claim 1 wherein said cylindrical skirt of the intermediate member is partially in axially sliding engagement with the walls of the recess and partially within the depending skirt of the swivel break-up insert.

9. A spray tip assembly according to claim 8 wherein said recess comprises an internal shoulder between an inner part of smaller diameter for axially sliding engagement with the intermediate member, and an outer part of larger diameter for axially sliding engagement with the depending skirt of the swivel break-up insert.

10. A spray tip assembly according to claim 1 mounted on a pressurised dispensing container.

* * * * *